US011242833B2

(12) United States Patent
Serra et al.

(10) Patent No.: US 11,242,833 B2
(45) Date of Patent: Feb. 8, 2022

(54) INJECTOR CUP, SPRING CLIP, AND FLUID INJECTION ASSEMBLY

(71) Applicant: CPT Group GmbH, Hannover (DE)

(72) Inventors: Giandomenico Serra, Ghezzano-S.Giuliano Terme (IT); Gisella Di Domizio, San Giuliano Terme (IT)

(73) Assignee: VITESCO TECHNOLOGIES GMBH, Hanover (DE)

( * ) Notice: Subject to any disclaimer, the term of this patent is extended or adjusted under 35 U.S.C. 154(b) by 135 days.

(21) Appl. No.: 16/340,125

(22) PCT Filed: Oct. 10, 2017

(86) PCT No.: PCT/EP2017/075836
§ 371 (c)(1),
(2) Date: Apr. 7, 2019

(87) PCT Pub. No.: WO2018/069336
PCT Pub. Date: Apr. 19, 2018

(65) Prior Publication Data

US 2020/0011280 A1 Jan. 9, 2020

(30) Foreign Application Priority Data

Oct. 12, 2016 (DE) ..... 16193477.3

(51) Int. Cl.
*F02M 61/14* (2006.01)
*F02M 61/16* (2006.01)

(52) U.S. Cl.
CPC ..... *F02M 61/14* (2013.01); *F02M 61/168* (2013.01); *F02M 2200/16* (2013.01);
(Continued)

(58) Field of Classification Search
CPC .. F02M 61/14; F02M 61/168; F02M 2200/16; F02M 2200/8023; F02M 2200/853; F02M 2200/856
(Continued)

(56) References Cited

U.S. PATENT DOCUMENTS 5,501,195 A * 3/1996 Hall ..... F02M 61/145 123/470
5,970,953 A * 10/1999 Lorraine ..... F02M 61/14 123/470
(Continued)

FOREIGN PATENT DOCUMENTS

EP 1 703 121 A1 9/2006 ..... F02M 61/14
EP 2 221 469 A1 8/2010 ..... F02M 55/02
(Continued)

OTHER PUBLICATIONS

Chinese Office Action, Application No. 201780063443.7, 23 pages, dated Aug. 4, 2020.
(Continued)

*Primary Examiner* — David Hamaoui
*Assistant Examiner* — John D Bailey
(74) *Attorney, Agent, or Firm* — Slayden Grubert Beard PLLC

(57) ABSTRACT

Various embodiments include an injector cup comprising: a cup body extending along a central longitudinal axis from a first axial end to a second axial end; a ring adjoining a border of the second axial end and radially extending beyond said border; wherein a base surface of the ring faces away from the first axial end and defines a reference plane extending orthogonally to the longitudinal axis; the ring comprises two wings, wherein each wing includes a free end section extending bent away from the reference plane at a side of the reference plane facing towards the cup body, wherein the
(Continued)

two wings are spaced from each other; and a through opening in the ring disposed between the two wings.

5 Claims, 7 Drawing Sheets

(52) U.S. Cl.
CPC ..... *F02M 2200/8023* (2013.01); *F02M 2200/853* (2013.01); *F02M 2200/856* (2013.01)

(58) Field of Classification Search
USPC ..... 123/470
See application file for complete search history.

(56) References Cited

U.S. PATENT DOCUMENTS

| | | | | |
|---|---|---|---|---|
| 6,276,339 | B1 * | 8/2001 | Shebert, Jr. | F02M 61/14 123/470 |
| 6,481,420 | B1 * | 11/2002 | Panasuk | F02M 55/004 123/469 |
| 9,032,934 | B2 * | 5/2015 | Nakamura | F02M 69/04 123/470 |
| 10,094,351 | B2 * | 10/2018 | Oh | F02M 61/14 |
| 2004/0045530 | A1 * | 3/2004 | Schoeffler | F02M 61/168 123/457 |
| 2006/0137659 | A1 * | 6/2006 | Zdroik | F02M 69/042 123/470 |
| 2007/0266996 | A1 * | 11/2007 | Zdroik | F02M 55/005 123/445 |
| 2008/0105236 | A1 * | 5/2008 | Scheffel | F02M 61/168 123/470 |
| 2009/0056674 | A1 * | 3/2009 | Furst | F02M 61/14 123/470 |
| 2010/0218743 | A1 * | 9/2010 | Marc | F02M 61/168 123/470 |
| 2011/0232609 | A1 * | 9/2011 | Roseborsky | F02M 61/14 123/470 |
| 2013/0192565 | A1 * | 8/2013 | Roseborsky | F02M 61/14 123/470 |
| 2015/0013643 | A1 * | 1/2015 | Serra | F02M 61/168 123/470 |
| 2015/0101572 | A1 * | 4/2015 | Serra | F02M 61/14 123/470 |
| 2015/0128908 | A1 * | 5/2015 | Matteini | F02M 61/14 123/470 |
| 2019/0170101 | A1 * | 6/2019 | Pasquali | F02M 61/168 |

FOREIGN PATENT DOCUMENTS

| | | | | |
|---|---|---|---|---|
| EP | 2 388 469 | A1 | 11/2011 | F02M 55/00 |
| EP | 2 860 388 | A1 | 4/2015 | F02M 61/14 |
| EP | 2 910 768 | A1 | 8/2015 | F02M 55/02 |
| WO | 2018/069336 | A1 | 4/2018 | F02M 61/14 |

OTHER PUBLICATIONS

Extended European Search Report, Application No. 16 19 3477.3, 7 pages, dated Apr. 18, 2017.

International Search Report and Written Opinion, Application No. PCT/EP2017/075836, 10 pages, dated Jan. 9, 2018.

* cited by examiner

INJECTOR CUP, SPRING CLIP, AND FLUID INJECTION ASSEMBLY

CROSS-REFERENCE TO RELATED APPLICATIONS

This application is a U.S. National Stage Application of International Application No. PCT/EP2017/075836 filed Oct. 10, 2017, which designates the United States of America, and claims priority to EP Application No. 16193477.3 filed Oct. 12, 2016, the contents of which are hereby incorporated by reference in their entirety.

TECHNICAL FIELD

The present disclosure relates to internal combustion engines. Various embodiments include injector cups, spring clips, and/or fluid injection assemblies for an internal combustion engine.

BACKGROUND

Injection valve assemblies are in widespread use, in particular for internal combustion engines where they may be arranged in order to dose a fluid to a cylinder. A high-pressure injector may be clamped on the cylinder head to ensure a correct position of its tip inside the combustion chamber. In addition, the orientation of the high-pressure fuel injector with respect to the combustion chamber must be guaranteed to reach desired engine performances. This function is needed in order to control in an accurate way the fuel spray targeting inside the combustion chamber. Uncontrolled tip or spray position would have a negative impact on engine emission and performances.

In order to meet these requirements regarding internal combustion engines having a fuel rail, the injector cups which are connected to the fuel rail are fixed to the cylinder head for example by screws, clamps, or the like in an intended relative position. It is known that at each injector its fluid inlet end is sealingly inserted into a cavity of a respective injector cup and to hold the respective injector at its injector cup by means of a spring clip.

In addition to the above-mentioned requirements, the injector under operation conditions can slightly move along its longitudinal direction relative to its injector cup whereas any inclination of the injector relative to the injector cup has to be avoided. An inclination of the injector may result in an unintended dismounting of the injector in particular during handling and transportation, but also during assembly if no appropriate provisions are made against this risk. This particularly pertains to the transportation because at this state the injectors are already mounted at the injector cups but not yet mounted to a cylinder head, as described in EP 2 910 768 A1 with reference to FIG. 1.

In the prior art as shown by FIG. 13 it is known an injector cup 1' for a fluid injection assembly of an internal combustion engine, wherein the injector cup 1 comprises a cup body 2' and a cup ring element 3'. The cup body 2' extends along a central longitudinal axis A' from a first axial end 4' to a second axial end 5' and the cup ring element 3' adjoins the border of the second axial end 5' by radially extending beyond said border 6'. A base surface 7' of the cup ring element 3' faces away from the first axial end 4' and defines a cup reference plane 8' which extends orthogonally to the longitudinal axis A'. The injector cup 1' is fixed to a fuel rail 9' by intermediate means 10'.

As a further component a so-called stiffener 11', which is a bent sheetmetal part, is brazed to the injector cup 1' with the double aim of minimizing an injector spring clip inclination and an injector spring clip axial movement, thanks to the locally increased thickness given by the contribute of the two brazed sheet-metal components, i.e. the injector cup in the stiffener. A spring clip (which is not shown in FIG. 13) can be connected to the injector (also not shown in FIG. 13). The problem of the movement of the injector would imply a risk of loosening the injector during transportation and mounting problems could arise during the assembly in the engine head. In the prior art also designs of an injector cup without such a brazed stiffener are known. Reference is made to EP 2 860 388 A1.

SUMMARY

Various embodiments of the teachings of the present disclosure include an injector cup comprising: a cup body extending along a central longitudinal axis of the injector cup from a first axial end of the cup body to a second axial end of the cup body; and a cup ring element which adjoins the border of the second axial end by radially extending beyond said border; wherein a base surface of the cup ring element faces away from the first axial end and defines a cup reference plane which extends orthogonally to the longitudinal axis.

Some embodiments include a spring clip for a fluid injection assembly for an internal combustion engine, wherein the spring clip comprises: two legs which extend alongside and spaced from each other; two fork arms which extend alongside and spaced from each other; and a connecting portion; wherein each of the legs has a curved section, an angled section and a flat section which is formed between the curved section and the angled section of the respective leg, wherein each of the flat sections has a base surface which extends along a clip reference plane or which at least is tangent to a clip reference plane, wherein at the side of the clip reference plane which faces away from the base surfaces each of the curved sections extends away from the clip reference plane by having a shape like a C-profile, wherein at the side of the clip reference plane which faces away from the base surfaces the angled sections extend away from the clip reference plane and are connected to each other, in particular spaced from the clip reference plane by the connecting portion.

Some embodiments include a fluid injection assembly for an internal combustion engine, wherein the fluid injection assembly extends along a central longitudinal axis and comprises: an injector, comprising an injector tube and an injector body which is fixed to said injector tube, an injector cup and a spring clip.

Some embodiments include a method for assembling a fluid injection assembly for a combustion engine, comprising the steps: providing a spring clip and an injector cup and providing an injector, comprising an injector tube and an injector body which is fixed to said injector tube, wherein the injector body has a central opening and a slit, wherein the central opening extends along the longitudinal axis, and wherein the slit crosses the central opening and extends parallel or inclined with respect to a plane which is orthogonally to a central longitudinal axis.

BRIEF DESCRIPTION OF THE DRAWINGS

Exemplary embodiments of the teachings of the present disclosure (FIGS. 1-12) and an injector cup known in the prior art (FIG. 13) are described with reference to the accompanying drawings. These are as follows:

FIG. 8 is a perspective view of the arrangement shown by FIGS. 5-7;

FIG. 9 is an enlarged view of detail IX of FIG. 8;

DETAILED DESCRIPTION

Figure 1:
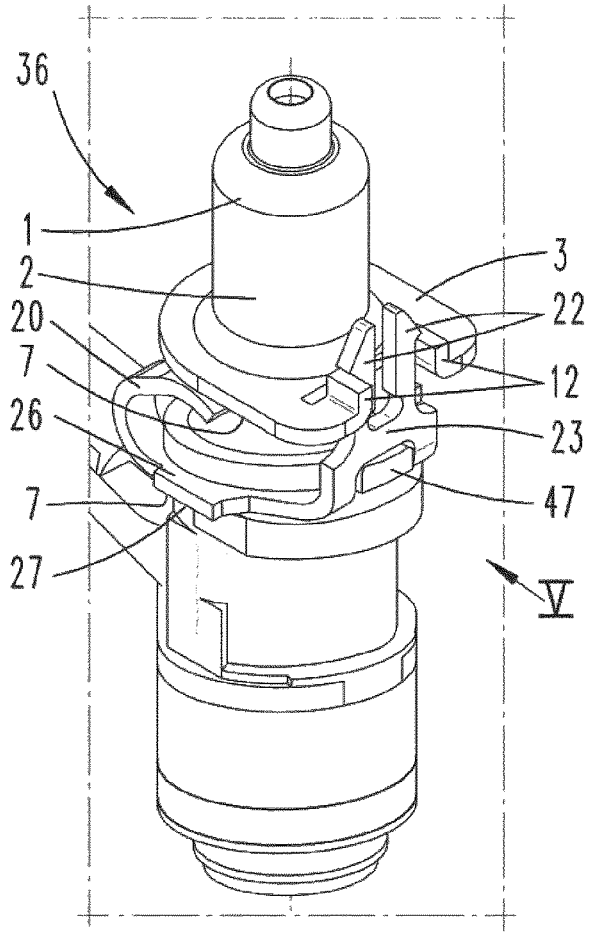
FIG. 1 is a perspective view of an injector cup which is mounted by a spring clip to an injector body of an injector incorporating teachings of the present disclosure wherein the injector tube is not shown in FIG. 1.

The present disclosure describes an improved injector cup. In particular, various embodiments include an injector cup which can contribute to a reduction of an inclination of an injector mounted with said injector cup by a spring clip without the need of fixing a separate stiffener to the injector cup. Some embodiments include an improved spring clip appropriate to contribute to a reduction of an inclination of an injector which is mounted to an injector cup by the spring clip.

Some embodiments include a fluid injection assembly including an injector, a spring clip and an injector cup, to achieve at least some of the afore-mentioned objects mentioned above. Some embodiments include a method for assembling a fluid injection assembly. Further advantages, example embodiments, and developments of the injector cup, the spring clip, the fluid injection assembly, and the method are mentioned in the following description and the drawings.

In some embodiments, the cup ring element comprises two wings. Each wing has a free end section which extends bent away from the cup reference plane at the side of the cup reference plane which faces towards the cup body, i.e. which faces in particular towards the first axial end. The two wings are spaced from each other and wherein a through opening is provided in the cup ring element between the two wings. The first axial end may be a fuel inlet end of the injector cup.

In some embodiments, the two wings may be designed by simply cutting and bending so that it is ensured that arms of a spring clip, which may be used for mounting a fuel injector to the injector cup, are in contact with the injector cup also in case of an injector inclination, avoiding the risk of a loosening of the injector from the injector cup, for example during transport or handling. The effect of the locally increased thickness which was obtained in the past by brazing two different sheet-metal components together can now be obtained thanks to the combination of cutting and bending operations which provides the metal in the right position and with the right thickness directly on the injector cup without the need of any additional component as a stiffener.

In some embodiments, the through opening may extend through the cup ring element in a direction perpendicular to the cup reference plane. The two wings may be spaced from each other in a lateral direction which extends parallel to the cup reference plane and transversally or orthogonally to a direction which extends radially with respect to the longitudinal axis. In some embodiments, the injector cup is a fuel rail injector cup, i.e. an injector cup which is capable or in particular adapted to be mounted to a fuel rail.

In some embodiments, each wing has an end face which extends parallel to or inclined to the cup reference plane and/or that each wing has a front side face which extends relative to the cup reference plane angled by a bending angle wherein both front side faces face each other and/or that both wings are formed mirror symmetrically to each other and/or that the end sections of the wings extend orthogonally with respect to the cup reference plane. In some embodiments, the wings may be formed by a first step of cutting in the cup ring element a cut line or a recess having a shape like a T-profile extending along the cup reference plane in order to create the two wings each having an end face wherein both end faces face each other, and by a subsequent step of bending the end section of each wing away from the cup reference plane.

In order to provide "tracks" which may be contacted by a spring clip, each end face may adjoin its neighboring front side face at an edge, wherein the edge has a length in a range of some millimeters and/or wherein the end face in a direction parallel to this edge has a length in a range of some millimeters.

In some embodiments, each of the fork arms at its respective one end is connected to the connecting portion and extends from the connecting portion towards its respective other end away from the clip reference plane, that each of the fork arms at its respective side which faces away from the respective other fork arm comprises a projection which is spaced from the connecting portion and which is directed away from the respective other fork arm and that at least one of the fork arms or each of the fork arms is deflectable elastically towards the respective other fork arm. The spring clip may be adapted to be used for mounting a fluid injector for an internal combustion engine to an injector cup, in particular to an injector cup of a fuel rail for an internal combustion engine.

In some embodiments, the spring clip may be designed so that each of the projections has a triangular cross section. Further, the fork arms may be formed mirror-symmetrically with respect to a symmetry plane which extends orthogonally to the clip reference plane, that each of the fork arms comprises a post, wherein at each fork arm its respective projection extends from an end of its post, and that each projection comprises a first surface and a second surface, wherein the first surface abuts the respective post and extends from the post in a first direction away from the symmetry plane and wherein the second surface abuts the first surface and extends from the first surface in a direction towards the symmetry plane. In some embodiments, the first direction is orthogonally or inclined with respect to the symmetry plane and that the second direction is inclined with respect to the symmetry plane. Preferably the spring clip consists of metal or includes metal, preferably having incisive elastic properties.

In some embodiments, the injector cup is an injector cup according to one or more of the embodiments described above and that the spring clip is a spring clip in accordance with one of the embodiments described above. In some embodiments, the fluid injection assembly is adapted to be connected to a fuel rail. The injector body may be overmolded to the injector tube. The function of the two wings of the injector cup is to block the fork arms of the spring clip in order to avoid a kind of movement of the injector which could result in the risk of loosening the injector and accordingly in order to solve respective problems which may occur for example during transportation and during assembly.

In some embodiments, the injector body has a central opening and a slit, wherein the central opening extends along the longitudinal axis, that the slit crosses the central opening and extends parallel or inclined with respect to a plane which is orthogonally to the longitudinal axis, that the injector tube extends through the central opening, that the flat sections of the legs are inserted in the slit so that the flat sections encompass the injector tube and that the fork arms extend along the longitudinal axis in a direction toward a fluid inlet end of the injector.

In some embodiments, each of the flat sections of the spring clip may have an edge section facing toward the respective other flat section which may be shaped concavely so that in an undeformed state of the spring a minimum lateral distance between these edge sections is less compared to an outer diameter of a longitudinal section of the injector tube which is determined to be encompassed by the flat sections. During the spring is mounted at the injector, due to the elastic properties the legs may be deflected somewhat laterally in an outward direction so that its minimum lateral distance exceeds the mentioned diameter of the injector tube and so that inserting of the flat sections in the slit is possible. Thereafter the legs due to its elastic deformation may move back towards its undeformed shape until they contact the injector tube or until they are even pressed against the injector tube due to a remaining elastic force. Accordingly, the spring clip may be attached to the injector tube by a lateral snap fit connection so that it is not possible to lose the spring clip after mounting.

In some embodiments, a fluid inlet end of the injector is sealingly inserted into a cavity of the injector cup, that each projection comprises a tip wherein the tips are arranged in a lateral tip distance from each other, that between the wings a clearance is provided which is less compared to the lateral tip distance, that the arms extend through the clearance between the wings, wherein the one of the projections, in particular at its first surface, is in contact to the one of the wings and the other of the projections, in particular at its first surface, is in contact to the other of the wings. Thereby an axial form fit can be achieved in order to limit an axial relative movement of the injector and the injector cup away from each other to a determined distance. Accordingly, the function is to block the fork arms of the clip spring.

Furthermore, thanks to the wings of the injector which may be formed by double bending, also a tilting of the injector with respect to a central longitudinal axis, which can cause disassembling during handling and transport, is limited, in particular thanks to tracks formed by the two bended wings as described before. The shape of the wings, in particular their length and width, and/or the shape of the arms, in particular their lengths and shapes of their projections, may be designed and determined in order to guarantee that projections of the arms are in contact with the injector cup also in case of an injector inclination, avoiding the risk of a loosening of the injector from the injector cup, for example during transport or handling.

In some embodiments, each of the curved sections of the spring clip comprises a respective free end section, wherein both free end sections are held or even pressed against the base surface of the cup ring element due to an elastic compression of the curved sections. This can be achieved by determining a length of the arms which is appropriate for this purpose. As a consequence, the spring clip exerts an elastic spring force in the direction of the longitudinal axis such that the injector body and the injector cup are pushed away from each other. On mounting the fluid injection assembly to a housing of a combustion engine the injector cup may be fixed at the housing in a determined distance from it so that the clip spring may press the injector against the housing towards a cylinder on exerting an intended force.

In some embodiments, the injection body consists of or includes plastic material and/or is integrally formed (i.e. formed as a single piece). In particular the injection body has been produced by overmolding to the injector tube.

In some embodiments, the injector body comprises a radially extending protrusion having a protrusion width with respect to a circumferential direction, that adjacent to the connecting portion the angle sections 25 have a lateral clearance between them which has a lateral width which is slightly bigger or equal compared to the protrusion width and that the protrusion extends into the lateral clearance between the fork arms so that the protrusion and the fork arms provide a form fit for blocking a rotation relative to each other around the central longitudinal axis. After the fluid injection assembly has been mounted at a combustion engine it can be ensured by such resulting rotational form fit that no rotation of the injector is possible relative to the cylinder. In other words, the protrusion and the lateral clearance act together for an indexing (anti-rotation) function whereby the protrusion provides a rotational stop with respect to the arms of the spring clip.

In some embodiments, the injector cup is an injector cup as described herein, the spring clip is a spring clip as described herein, the flat sections of the legs are inserted into the slit so that the flat sections encompass the injector tube and in particular so that the protrusion extends into the lateral clearance between the angled sections of the legs, and subsequently a fluid inlet end of the injector is axially inserted into a cavity of the injector cup by passing the fork arms of the spring clip through the clearance between the wings so that the fork arms starting from an undeformed shape at first are deflected towards each other until the protrusions extend beyond the wings so that the fork arms elastically spring back away from each other.

An example embodiment of an injector cup 1 incorporating the teachings herein is shown by FIG. 1 and FIGS. 4-12. It comprises a cup body 2 and a cup ring element 3. The cup body 2 extends along a central longitudinal axis A of the injector cup 1 from a first axial end 4 to a second axial end 5. The cup ring element 3 adjoins a border 6 of the second axial end 5 by radially extending beyond said border 6. A base surface 7 of the cup ring element 3 faces away from the cup body 2 and defines a cup reference plane 8. Said plane extends orthogonally with respect to the longitudinal axis A. The cup ring element 3 comprises two wings 12. The wings 12 as well as its respective details are indicated by corresponding reference signs. Each wing 12 has a first end section which is integrally connected to the adjoining flat wall 15 of the cup ring element 3. Further, antipodal to the first end each wing 12 has a respective free end section 13 which extends bent away from the cup reference plane 8 at the side of the cup reference plane 8 which is towards the cup body 2. Both wings 12 are spaced from each other by a through opening 14 which extends through the cup ring element 3 in a direction perpendicular to the cup reference plane 8.

Figure 5:
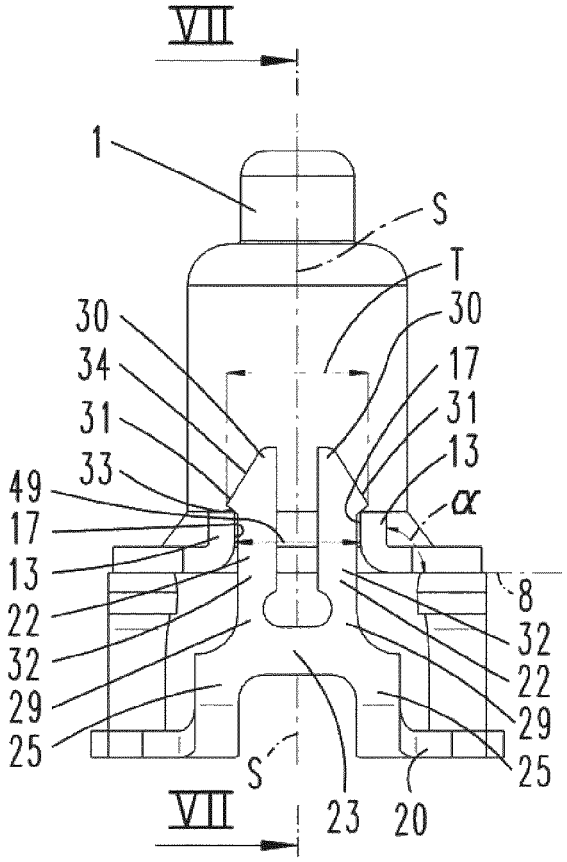
FIG. 5 is a side view of the injector cup of FIG. 4 connected to the spring clip of FIG. 3 in a viewing direction V of FIG. 1.

Each wing 12 comprises an end face 16 which extends parallel or slightly inclined to the cup reference plane 8. Further, each wing 12 has a front side face 17 which extends relative to the cup reference plane 8 angled by a bending angle $\alpha$ which in the example of FIG. 5 is 90 degree. Both front side faces 17 face towards each other. Both wings 12 are formed mirror symmetrically to each other with respect to a symmetry plane S (see also FIG. 5). Because the bending angle $\alpha$ is 90 degree in the example, the end sections 13 of the wings extend orthogonally with respect to the cup reference plane 8. In the example the wings 12 are formed by a first step of cutting in the cup ring element 3 a recess which has a shape like a T-profile before bending of the wings 12 is performed. Before performing the bending both end faces 16 face to each other. After forming the cut the end sections 13 of the wings 12 have been bent away from the cup reference plane 8 in a subsequent step.

Each end face 16 adjoins its neighboring front side face 17 at an edge 19 which as well as both adjoining faces 16, 17 have a length of some millimeters with respect to a direction which is parallel to the symmetry plane S. In the example the injector cup 1 is integrally formed, i.e. formed as a single piece.

FIGS. 1, 3 and 5-12 show an example embodiment of a spring clip 20 incorporating the teachings herein. It comprises two legs 21 extending alongside and spaced from each other. Further, the spring clip 20 comprises two fork arms 22 and a connecting portion 23. The fork arms 22 extend alongside and spaced from each other. Each of the legs 21 has a curved section 24, an angled section 25 and a flat section 26 formed therebetween. Each of the flat sections has a base surface 27 (see FIG. 7) which extends along a clip reference plane 28. At the side of the clip reference plane 28 which faces away from the base surfaces 27 each of the curved sections 24 extends away from the clip reference plane 28 due to a shape like a C-profile. Also at the same side of the clip reference plane 28 the angled sections 25 extend away from the clip reference plane 28. In the example, the angled sections 25 are angled by a bending angle $\beta$ of 90 degrees with respect to the clip reference plane 28. Both angled sections 25 are laterally connected by the connecting portion 23 (see for example FIG. 5).

Each fork arm is connected at its respective one end 29 to the connecting portion 23 and extends therefrom towards its respective other end 30 away from the clip reference plane 28. Each of the fork arms 22 has at its respective side which faces away respective other fork arm 22 a projection 31 which is directed away from the respective other one of the fork arms 22. In the example the spring clip 20 is integrally formed and consists of an elastic metal. Accordingly, both fork arms 22 are deflectable elastically towards the respective other fork arm 22. Like the injector cup 1 also the spring clip 20 is formed mirror symmetrically with respect to the symmetry plane S. In more detail, each of the fork arms 22 comprises a post 32 and the projection 31 which is integrally formed at the respective end 30 of the fork arm 22. Each of the projections 31 comprises a first surface 33 and a second surface 34 meeting each other in a tip 35 of the projection 31. The tip 35 extends along a line which has a length of some millimeters in the example.

Figure 2:
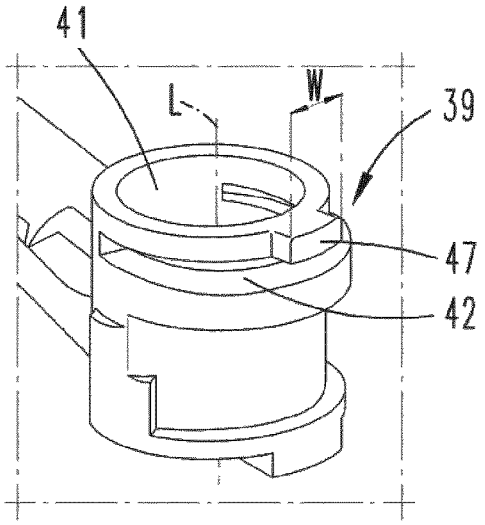
FIG. 2 is a perspective view of the injector body of FIG. 1.
Figure 3:
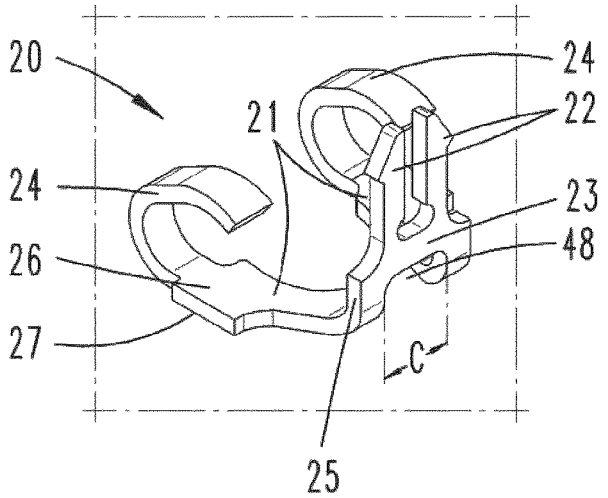
FIG. 3 is a perspective view of the spring clip of FIG. 1.
Figure 4:
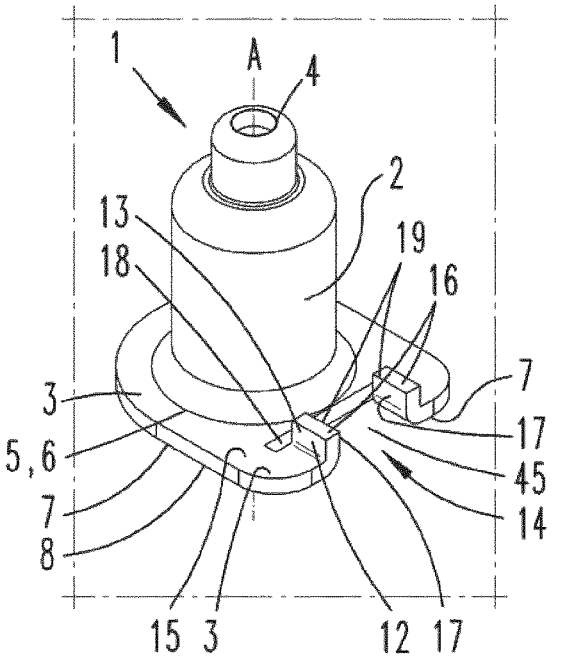
FIG. 4 is a perspective view of the injector cup of FIG. 1.
Figure 10:
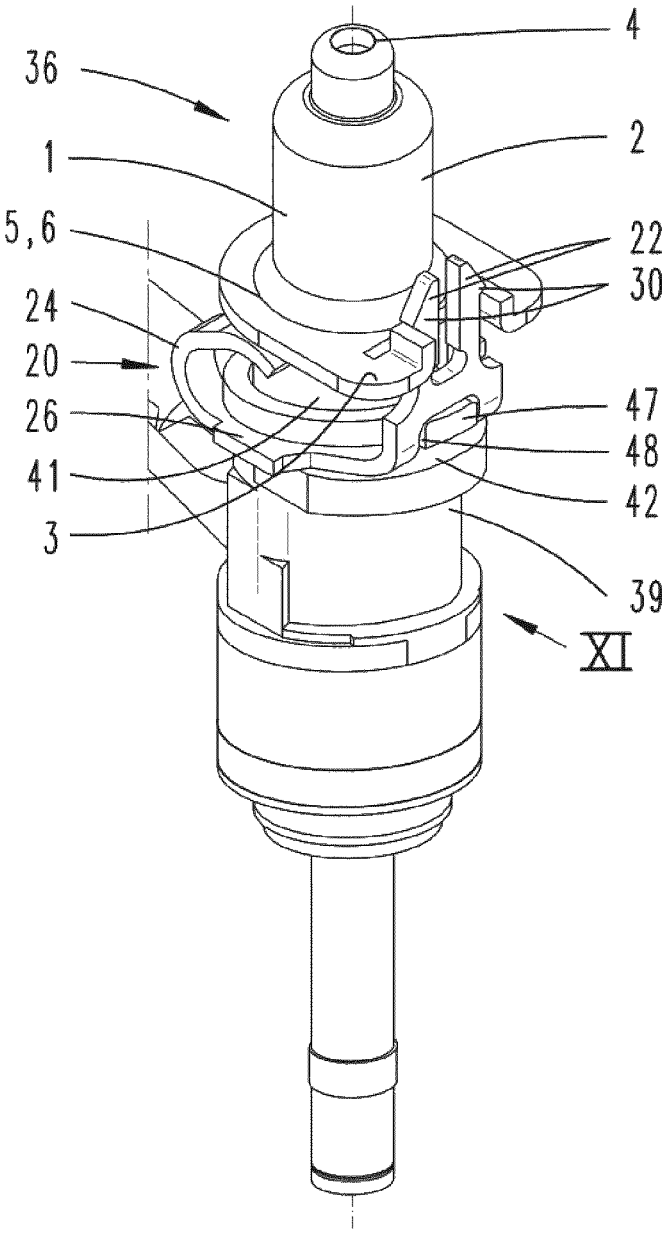
FIG. 10 is a perspective view of the arrangement of FIG. 1, however together with the injector tube of the injector incorporating teachings of the present disclosure.
Figure 11:
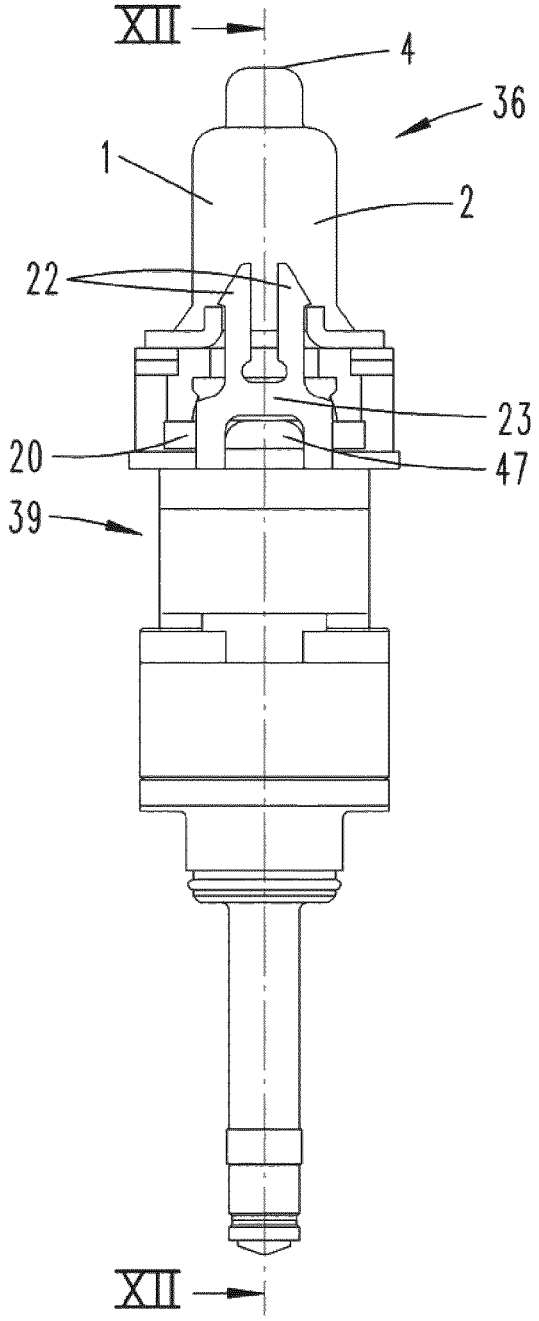
FIG. 11 is a side view of the assembly shown by FIG. 10 in viewing direction XI.
Figure 12:
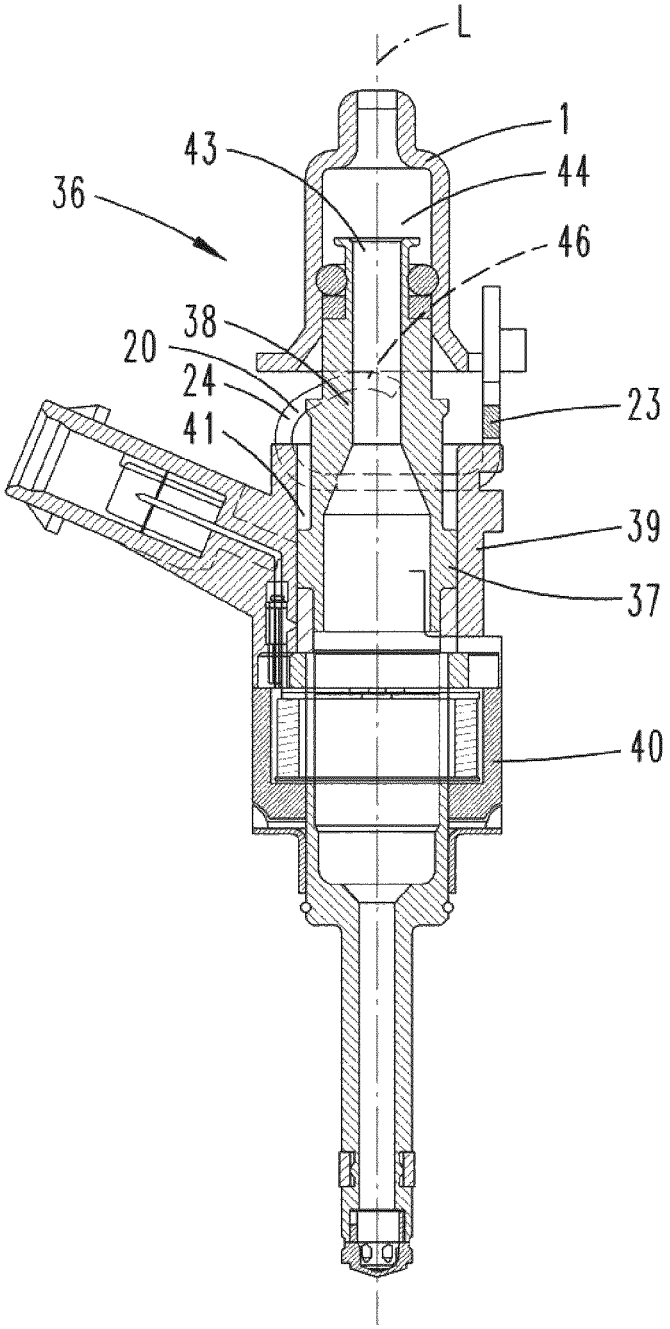
FIG. 12 is a cross section along section line XII-XII of FIG. 11.
Figure 13:
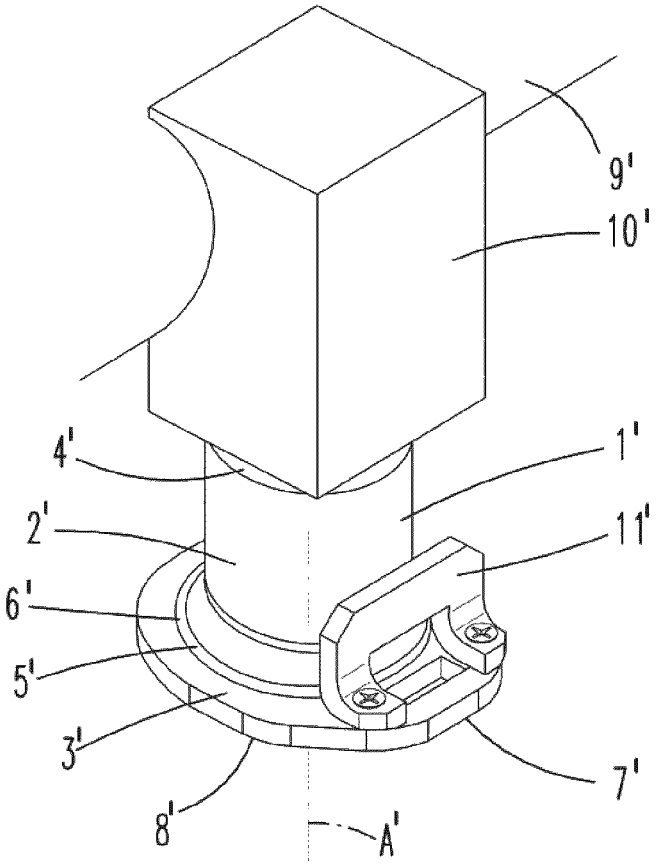
Fig. 13 (prior art)
FIG. 13 is a perspective view of an injector cup mounted to a fuel rail in accordance to the prior art.

An example embodiment of a fluid injection assembly 36 incorporating the teachings herein for an internal combustion engine (the latter is not shown) is depicted by FIGS. 10-12 and (without the injection tube) by FIG. 1. It extends along a central longitudinal axis L and comprises an injector 37, the above-described injector cup 1 and the above-described spring clip 20. The injector itself inter alia includes an injector tube 38, an injector body 39 and a casing 40 for accommodating further parts of the injector 37 like for example a solenoid. The injector body 39 is also shown by FIG. 2. It has a central opening 41 which extends along the longitudinal axis L. Further, the injector body 39 has a flat slit 42 which in the example extends parallel to a plane which is orthogonally to the longitudinal axis L so that the slit 42 crosses the central opening 41. In the mounted state (see for example FIG. 12) the injector tube 38 extends through the central opening 41 along the longitudinal axis L. The flat sections 26 of the legs 21 of the spring clip 20 are inserted into the slit 42 so that the flat sections 26 encompass the injector tube 38 and are pressed against the injector tube 38 due to elastic bending forces. The fork arms 22 extend along the longitudinal axis L in a direction toward a fluid inlet end 43 of the injector 37. Said fluid inlet end 43 of the injector 37 is sealingly pressed into a cavity 44 of the injector cup 1. The tips 35 of the projections 31 are arranged in a lateral tip distance T from each other as shown by FIG. 5, for example. Between the wings 12 is a clearance 45 which has a width 49 which is less compared to the lateral tip distance T. The fork arms 22 extend through the clearance 45 wherein each of the projections 31 is in contact to respective one of the wings 12. In more detail the respective first surface 33 is in contact to a respective edge 19 (see FIG. 9).

Each of the curved sections 24 of the spring clip 20 comprises a respective free end section 46, wherein both free end sections 46 are elastically pressed against the base surface 7 of the cup ring element 3 because of a slight elastic compression of the curved sections 24 in a direction parallel to the longitudinal axis L. In the example the injection body 39 is made of plastic material and is fabricated by overmolding onto the injector tube 38.

The injector body 39 comprises a radially extending protrusion 47 having a width W along a direction which is orthogonal to the radial direction. Between the clip reference plane 28 and the connecting portion 23 the angled sections 25 have a lateral clearance 48 between them which has a lateral width C which is slightly bigger compared to the protrusion width W. The protrusion 47 extends radially into the lateral clearance 48 between the fork arms 22 so that the protrusion 47 and the fork arms 22 act together for blocking a rotation relative to each other around the central longitudinal axis L.

Figure 6:
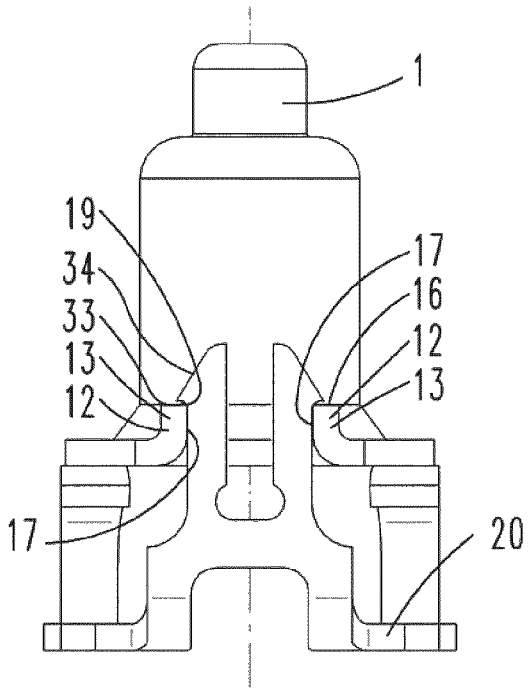
FIG. 6 is a side view of a possible alternative to the arrangement of FIG. 5 including slight amendments.
Figure 7:
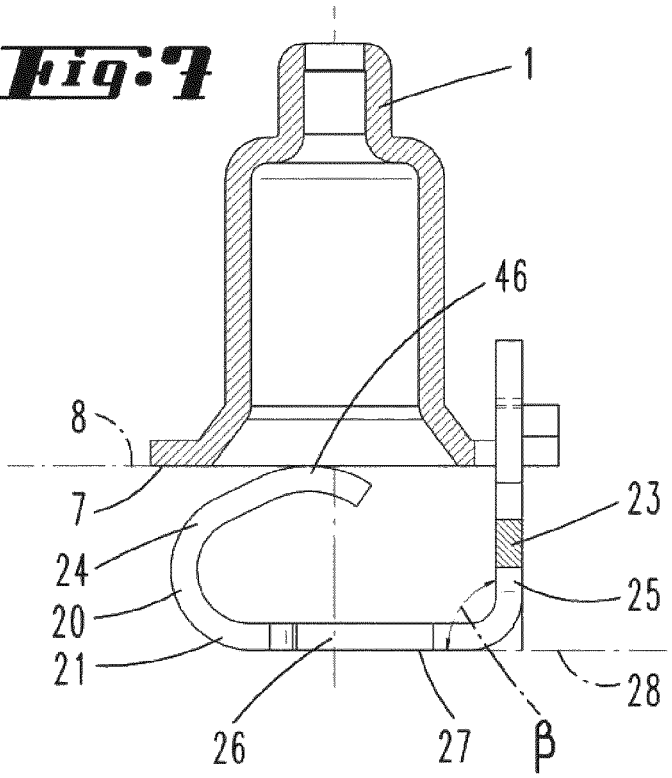
FIG. 7 is a cross section along section line VII-VII of FIG. 5.
Figure 5:
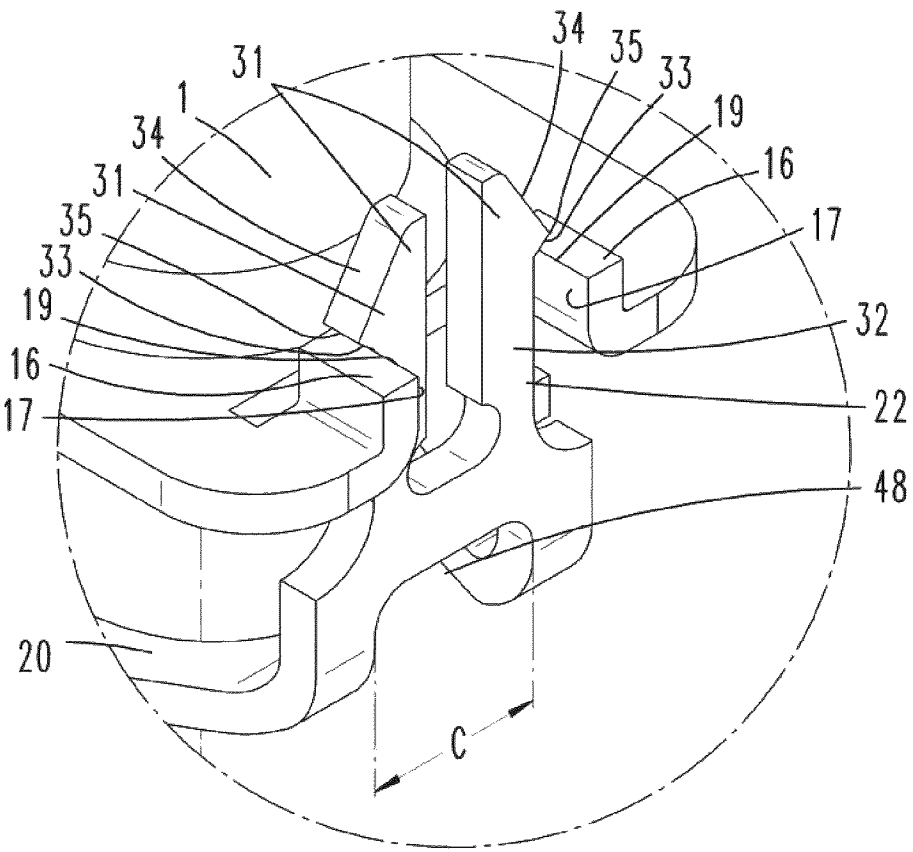
Figure 4:
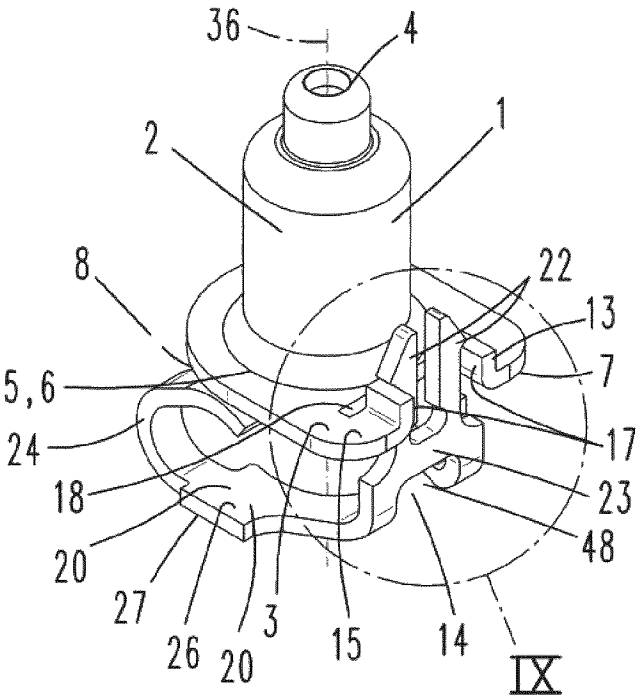

In the embodiment of the spring clip as shown by FIG. 5 the first surface 33 and the second surface 34 are both even. Differing therefrom, the second embodiment of the spring clip as shown by FIG. 6 the first surface 33 has a concave curvature in a cross section which is orthogonal to the edge 19.

What is claimed is:

1. An injector cup for a fluid injection assembly of an internal combustion engine, the injector cup comprising:

a cup body extending along a central longitudinal axis from a first axial end to a second axial end;

a ring adjoining a border of the second axial end and radially extending beyond said border;

wherein a base surface of the ring faces away from the first axial end and defines a reference plane extending orthogonally to the longitudinal axis;

the ring comprises two wings, wherein each wing including a base section extending from the ring in the reference plane along a respective tangent from a greatest radial extent of the ring, a corner section including a 90 degree turn from the respective tangent toward the respective opposing wing, a free end section extending parallel to the central longitudinal axis away from the reference plane defining a respective end surface parallel to the reference plane, and a curved section transitioning from the corner section to the respective free end section through 90 degrees, wherein the two wings are spaced from each other and each of the free end sections has a flat surface facing a respective flat surface of the free end section of the other of the two wings; and a through opening in the ring disposed between the respective flat surfaces of the free end section of the other of the two wings.

2. An injector cup according to claim 1, wherein the wings are cut from the ring along a cut line or a recess having a shape like a T-profile extending along the reference plane.

3. An injector cup according to claim 1, wherein each end face adjoins a neighboring front side face at an edge.

4. An injector cup according to claim 1, wherein:

each wing has a front side face extending angled relative to the cup reference plane by a bending angle; and both wings are formed mirror symmetrically to each other.

5. An injector cup according to claim 1, wherein:

each wing has a front side face extending angled relative to the cup reference plane by a bending angle; and the end sections of the wings extend orthogonally with respect to the cup reference plane.

* * * * *